US007294777B2

(12) United States Patent
Hofmeister et al.

(10) Patent No.: US 7,294,777 B2
(45) Date of Patent: Nov. 13, 2007

(54) ELECTRONIC TONE GENERATION SYSTEM AND BATONS THEREFOR

(75) Inventors: Mark R. Hofmeister, Collegeville, PA (US); Gregory L. Schwartz, Spinnerstown, PA (US)

(73) Assignee: Schulmerich Carillons, Inc., Sellersville, PA (US)

( * ) Notice: Subject to any disclaimer, the term of this patent is extended or adjusted under 35 U.S.C. 154(b) by 420 days.

(21) Appl. No.: 11/030,279

(22) Filed: Jan. 6, 2005

(65) Prior Publication Data

US 2006/0144212 A1 Jul. 6, 2006

(51) Int. Cl.
*G10H 1/00* (2006.01)

(52) U.S. Cl. ..... 84/615; 84/730; 84/732; 310/329; 310/330

(58) Field of Classification Search ..... 84/615, 84/730, 732; 310/329, 330
See application file for complete search history.

(56) References Cited

U.S. PATENT DOCUMENTS 5,290,964 A * 3/1994 Hiyoshi et al. ..... 84/600
5,585,584 A * 12/1996 Usa ..... 84/600
5,648,627 A 7/1997 Usa ..... 84/600
6,018,118 A 1/2000 Smith et al. ..... 84/600
6,198,034 B1 3/2001 Beach et al. ..... 84/600
6,919,503 B2 * 7/2005 Nishitani et al. ..... 84/633
2001/0015123 A1 8/2001 Nishitani et al. ..... 84/615
2002/0166437 A1 11/2002 Nishitani et al. ..... 84/600
2002/0170413 A1 11/2002 Nishitani et al. ..... 84/600
2003/0230186 A1 12/2003 Ishida et al. ..... 84/737
2004/0079220 A1 4/2004 Yagi ..... 84/484

OTHER PUBLICATIONS

Schulmerich Handbells, MelodyChime® Instruments, & Accessories 2002, 6 page brochure, Jun. 2002.
Co-pending U.S. Appl. No. 10/706,803, filed on Nov. 12, 2003.

* cited by examiner

*Primary Examiner*—Lincoln Donovan
*Assistant Examiner*—David S. Warren
(74) *Attorney, Agent, or Firm*—Howson & Howson LLP

(57) ABSTRACT

An electronic tone generation system including a plurality of separate, portable, handheld transmitters, or batons, that are provided as "instruments" to one or more players. Each baton can be activated to send a signal, preferably a wireless signal, to a single receiver which produces an output signal fed to a tone generator, preferably a MIDI tone generator, which produces audible sounds via an amplifier and speakers. For example, the batons can correspond to different musical notes as played by a selected musical instrument and the batons can be played in concert to produce a musical or other audible presentation. Alternatively, selected batons can be designated to play in one voice, while others batons are set to play other voices.

25 Claims, 5 Drawing Sheets

ELECTRONIC TONE GENERATION SYSTEM AND BATONS THEREFOR

BACKGROUND OF THE INVENTION

The present invention relates to an electronic tone generation system in which multiple, separate wireless transmitters, or batons, are utilized in association with a base station and tone generator to produce audible sounds.

U.S. Pat. No. 6,198,034 B1 issued to Beach et al. and assigned to Schulmerich Carillons Inc., the assignee of the present application, discloses an electronic tone generation system in which instruments in the form of portable handheld wireless transmitters are provided to a player or players. Activation of the transmitters sends signals to a single receiver that communicates with a tone generator to produce audible sounds. Thus, a musical or other presentation can be produced.

Co-pending U.S. patent application Ser. No. 10/706,803 filed on Nov. 12, 2003 and assigned to Schulmerich Carillons Inc., the assignee of the present application, also discloses handheld wireless batons and an electronic tone generation system. Each baton has a motion sensor, such as flexible piezoelectric reed, that produces waveform signals based on baton movement, and a play and/or mute signal is transmitted by the baton based upon the shape of the waveform produced by the motion sensor.

Although the electronic tone generation systems and handheld wireless transmitters (ie., batons) disclosed in the above cited patent and co-pending application may function satisfactorily for their intended purposes, there remains a need for improved batons and electronic tone generation systems.

With the foregoing in mind, a primary object of the present invention is to provide a reliable and easy-to-use baton/transmitter for an electronic tone generation system.

Another object of the present invention is to provide an electronic tone generation system that is user-friendly and provides numerous options with respect to its setup and operation.

SUMMARY OF THE INVENTION

According to one aspect of the present invention, a wireless handheld baton is provided for use in communicating with a receiver of an electronic tone generation system to produce audible sounds in response to movements of the baton. The baton has a housing with a grippable end portion and a pair of radiation sensors positioned on opposite sides of the housing from which a differential can be determined. For example, the radiation sensors can be used to sense the intensity of light to which opposite sides of the baton are exposed, and a differential of light intensity can be determined from these readings. A processor carried in the housing compares the differential with a set threshold level to determine whether or not to transmit a signal to the receiver of the electronic tone generation system to mute a sound being produced by the system.

According to another aspect of the present invention, a baton has a motion sensor carried on a circuit board that is mounted within a housing. A contact end of the motion sensor is electrically interconnected to a circuit on the circuit board, and a free end of the motion sensor flexes about an axis in response to movement of the baton and generates an electromagnetic waveform signal based on the flexural movement. Preferably, the axis is located at an intermediate location between the free and contact ends. For example, the motion senor can be a piezoelectric reed mounted within a block that engages opposed faces of the reed such that the free end is permitted to flex about the axis while the contact end remains stationary relative to the circuit board.

According to a further aspect of the present invention, an electronic tone generation system is provided and includes a plurality of separate handheld batons each capable of transmitting play and mute signals to a base station that generates an output signal based on the play and mute signals it receives from the batons. Each baton has a housing enclosing a circuit board on which a motion sensor, microprocessor and transceiver module are mounted. Each motion sensor generates a waveform signal as a function of baton movement and the orientation of the baton during the movement. Each transceiver module sends and receives signals from the base station and has operating parameters that are software controlled, and each microprocessor is programable and controls the operating parameters of the transceiver module.

Preferably, the base station includes a transmitter for periodically transmitting sync signals receivable by the batons, and each baton is programmed with a unique time slot for transmitting play and/or mute signals to the base station after receipt of a sync signal. This permits the plurality of batons to transmit signals one-at-a-time to the base station. Preferably the play and/or mute signals transmitted by the batons contain information of elapsed time between when a valid signal was ready to be transmitted to when the signal was actually transmitted during a next available time slot, and preferably the base station utilizes the elapsed time information to incorporate a consistent delay between when a valid signal is generated by a baton and when a corresponding sound is produced/muted by the electronic tone generation system. Further, preferably the base station includes: controls for adjusting its sensitivity; a foot-actuated pedal for switching between different stored system settings; controls for selecting the type of MIDI output signal to be generated; and a connection port for use in connecting an alternate instrument, such as a keyboard, to the base station to permit the alternate instrument to produce audible sounds in addition to, or in place of, one or more of the batons of the system.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
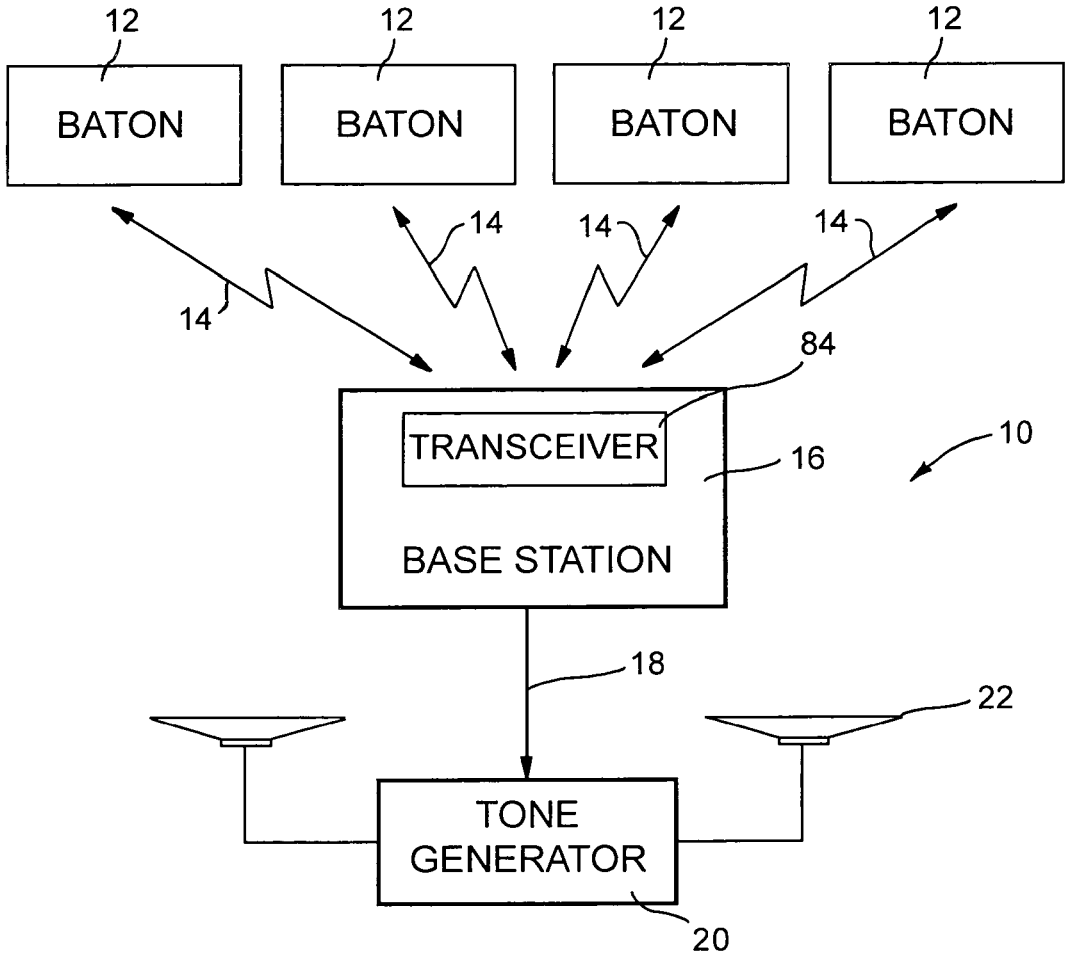
FIG. 1 is a block diagram of an electronic tone generating system according to the present invention.

An electronic tone generation system 10 according to the present invention is illustrated schematically in FIG. 1. The system 10 includes a plurality of separate, portable, handheld transmitters, or batons, 12 that are provided as separate "instruments" to one or more players. For example, a total of forty-nine separate batons 12 can be utilized. Each baton 12 can be activated by a player to transmit a valid play and/or mute signal 14 to a base station 16 which generates an output signal 18 based upon the valid play/mute signals received from the batons 12. The output signal 18 is fed to a tone generator 20, such as a MIDI tone generator, to produce audible sounds, for instance, via amplifier and speakers 22.

For purpose of example, the system 10 can be setup such that each baton 12 produces a selected type of sound at a different note of the musical scale. The sound may be that of a particular musical instrument or of some other type of sound (ie., dog barking, glass breaking, etc.) capable of being produced, for instance, by a MIDI tone generator. The batons can be set to produce the same type of sound, or one or more batons can be set to produce different types of sounds. Each baton can include indicia with respect to its designated musical note, for instance, see indicia "$C_4$" in FIG. 2 on the front face 26 of the baton 12. Preferably, a plurality of the batons 12 are played by one or more players to produce a musical and/or other presentation. Such systems are described in U.S. Pat. No. 6,198,034 B1 issued to Beach et al. and in co-pending U.S. patent application Ser. No. 10/706,803, the disclosures of which are incorporated herein by reference.

Figure 2:
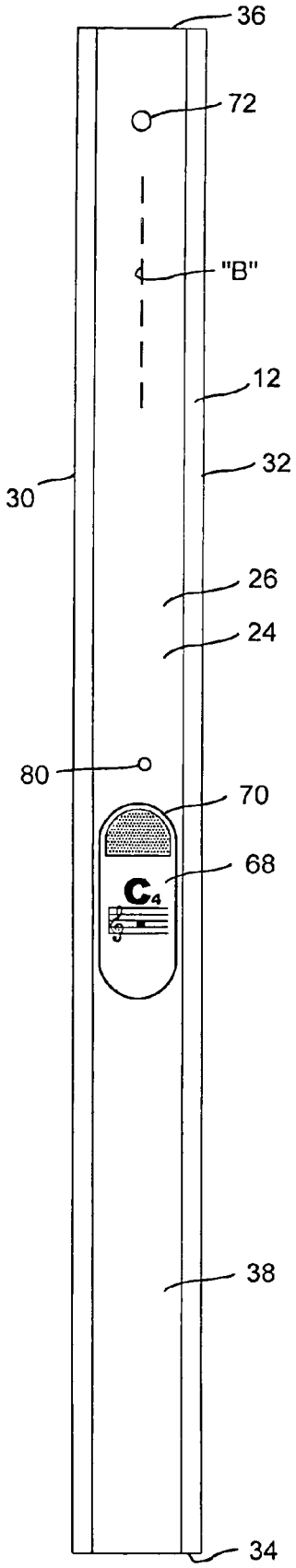
FIG. 2 is a plan view of the front face of a handheld wireless baton according to the present invention.
Figure 3:
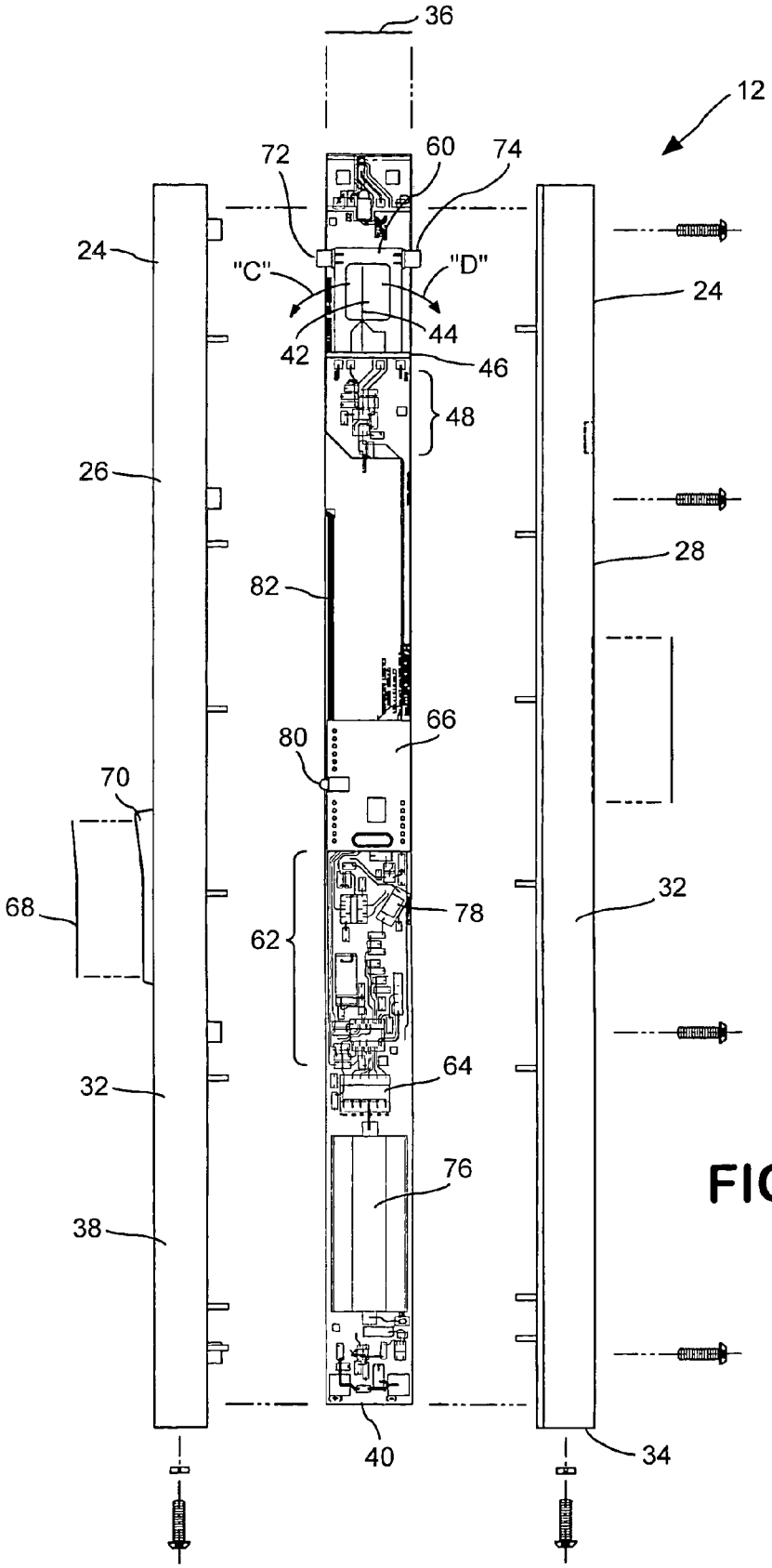
FIG. 3 is an exploded view of a handheld wireless baton according to the present invention.

The phrase "handheld transmitter" and the terms "baton" and "instrument" are used interchangeably herein. An example of a baton 12 is illustrated in FIGS. 2 and 3. The illustrated embodiment of baton 12 has an elongate, generally-rectangular housing 24 with a front face 26, a rear face 28, side faces 30 and 32, and end faces 34 and 36. An end portion 38 of the housing 24 is grippable by a hand of a player, or user. The shape of the baton 12 and/or housing 24 is a matter of design choice, and any configuration can be utilized and will be defined herein as a baton.

As best illustrated in FIG. 3, a circuit board 40 on which a motion sensor 42 is carried is mounted within the housing 24. As described in greater detail in co-pending U.S. patent application Ser. No. 10/706,803, the motion sensor 42 is preferably located a spaced distance from the end portion 38 of the housing and produces an electromagnetic signal, such as an electromagnetic waveform signal, in response to movements of the baton 12. For example, when the baton 12 is gripped and moved by a player, the motion is sensed by the motion senor 42 and a waveform signal is produced.

Figure 4:
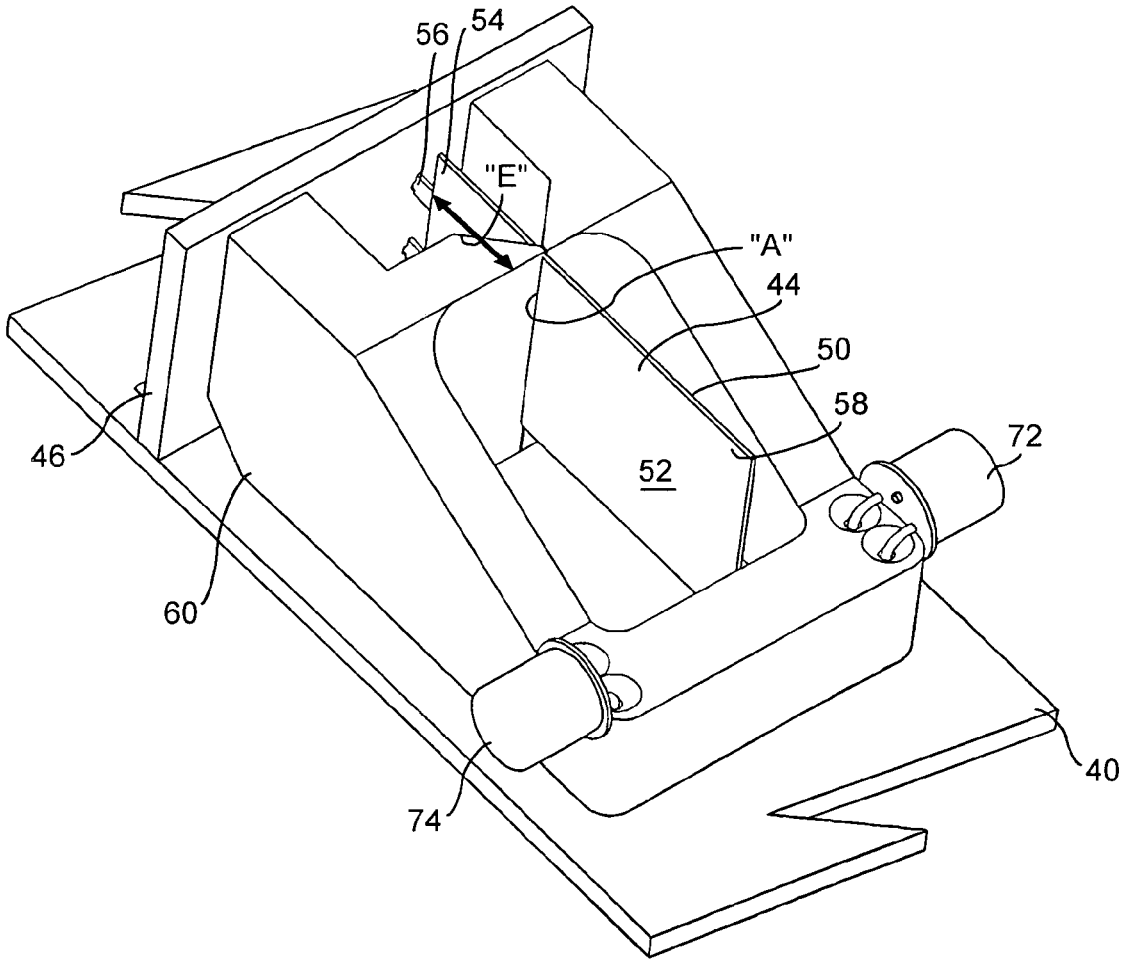
FIG. 4 is a perspective view of a motion sensor mounting block according to the present invention.

The motion sensor 42 can be, for instance, a piezoelectric film, or reed, 44 or like electronic component. An advantage provided by a such a component is that it operates silently and does not contain any potentially harmful substances, such as mercury. As illustrated in FIGS. 3 and 4, the piezoelectric film 44 is mounted in the housing 24 such that it is able to flex about an axis "A", which is preferably transverse, more preferably perpendicular, to a longitudinal axis "B" of the elongate housing 24. Arrow "C" in FIG. 3 shows the direction of flexural movement of the reed 44 toward the front face 26 of the housing 24 and arrow "D" illustrates the direction of flexural movement of the reed 44 toward the rear face 28 of the housing 24. The piezoelectric film 44 produces a voltage or like signal when flexed, and thus the signal has a polarity depending on whether the film 44 is flexing in a forward or rearward direction. The shape of the produced waveform can be used to determine whether or not the baton should transmit a valid "play" signal to the base station 16.

The waveform produced by the reed 44 is a function of the direction and orientation of baton movement as well as the extent and strength of the movement. For example, movement of the baton in a plane transverse, preferably perpendicular, to planar faces 50 and 52 of the reed 44 causes the reed 44 to bend in a significant manner and then quickly oscillate to an initial neutral position. Such movement will produce an alternating, or oscillating, waveform of a particular shape having sections of a specific polarity that can readily be identified by a signal processor and result in the baton 12 transmitting a play signal to the base station 16. Alternatively, if the movement of the baton is incidental, for instance, along a plane substantially coplanar with the planar faces 50 and 52 of the reed 44, or of relatively insignificant duration, velocity or acceleration, the flexure of the reed 44, if any, will produce a waveform significantly different to that discussed above and will not result in the transmission of a play signal. See the specific examples described in co-pending U.S. patent application Ser. No. 10/706,803.

One of the novel aspects of the baton 12 according to the present invention is the means for mounting the motion sensor 42 to the circuit board 40 to ensure reliable and consistent generation of waveforms. Preferably, the reed 44 is mounted on a shelf, or lateral extension, 46 extending from the circuit board 42 and is electrically interconnected to a signal processing circuit 48 on the circuit board 40. The reed, or film, 44 has planar front and rear faces, 50 and 52, an end 54 with electrical contacts 56, and an opposite free end 58. The electrical contacts 56 electrically interconnect to circuit 48 and apply the waveform signals produced by flexural movement of the reed 44 to the circuit 48.

In the illustrated embodiments, a mounting block 60 made of plastic or like material is mounted on the shelf 46 and/or circuit board 40 and engages the opposite faces 50 and 52 of the reed 44 at an intermediate location between the free end 58 and the contact end 54 thereby defining the axis "A" about which the reed 44 flexes. As best illustrated in FIG. 4, the block 60 engages the opposed faces of the reed 44 a spaced distance "E" from the electrical contacts 56. This enables the contacts 56 and end 54 to remain stationary relative to the circuit board 40 and shelf 46 and permit only the free end 58 extending beyond axis "A" to flex about axis "A". Such an arrangement provides the generation of consistent and repeatable waveforms and eliminates the potential of damage to end 54 and electrical contacts 56 due to repeated flexural movement.

As stated above, the circuit board 40 includes means for analyzing the waveforms generated by the motion sensor 42. For instance, see signal processing circuitry 48 and 62 in FIG. 3. Such signal processing circuitry is known in the art and, therefore, is not discussed in greater detail. Information concerning the waveform is provided to a microprocessor 64 which controls when, for instance, a transceiver 66 should transmit a signal to the base station 16. For example, a valid "play" signal may be transmitted by the transceiver 66 to the base station 16 to cause an audible sound to be produced by the tone generator 20 at a relative volume level and/or intensity based, at least partly, on the shape of the waveform and its amplitude. Alternatively, the signal processing circuitry may determine that the shape of the waveform is the result of incidental movement of the baton 12 and that no signal should be transmitted.

As best illustrated in FIG. 2, the baton 12 includes visible indicia means carried on the housing 24 for providing the user with information on proper gripping and orientation of the baton 12 and a desired plane of movement for generating a valid play signal. For example, a label 68 can be applied on the front face 26 of the baton 12 on a raised label mounting area 70.

Another novel aspect of the baton 12 of the present invention is the use of a pair of sensors 72 and 74, such as radiation sensors, to determine whether or not the baton 12 should transmit a "mute" signal to the base station 16 to cause the tone generator 20 to mute a sound currently being generated. The sensors 72 and 74 monitor a condition on opposite sides of the baton 12, and their readings are compared, for instance, by the microprocessor 64, to determine if a sufficient differential exists therebetween. If the differential is greater than a preset threshold level, then the microprocessor 64 causes the transceiver 66 to transmit a signal to the base station 16 to mute a sound. In addition, a valid "play" signal can only be transmitted by the baton 12 if a waveform generated by the motion sensor 42 is of a predetermined shape as discussed above and if the differential determined from sensors 72 and 74 is less than the preset threshold level.

As a specific example, the sensors 72 and 74 can be provided as light sensors that measure the intensity of ambient light to which opposed sides of the baton 12 are exposed. One of the light sensors 72 can be located on the front face 26 of baton 12 (see FIG. 2) and the other sensor 74 can be located on the rear face 28 of the baton 12 (see FIG. 3). If a player causes a sound to be produced via movement of the baton 12 and thereafter desires the sound to be abruptly muted, the player can position the baton 12 such that one of the sensors, 72 or 74, is substantially shielded from ambient light while the other is exposed to ambient light. This creates the required differential to cause the baton 12 to transmit a "mute" signal and can be accomplished, for instance, by positioning the baton 12 on a table surface so that one of the sensors, 72 or 74, faces the table surface thereby shielding it from light. Alternatively, the baton can be rested on the player, such as on the player's shoulder, so that the player's body shields one of the sensors, 72 or 74, from light.

As best illustrated in FIGS. 3 and 4, preferably the mounting block 60 mounts the motion sensor 42 as well as the radiation sensors 72 and 74 to the circuit board 40. Preferably, the radiation sensors 72 and 74 are mounted on opposite sides of the reed 44 and are positioned in a plane that extends transverse, more preferably perpendicular, to the planar faces 50 and 52 of the reed 44. See FIG. 4. For purposes of example, the radiation sensors 72 and 74 can be photo cells. However, other sensors, such as heat sensors or sensors which can sense other types of radiant energy can be utilized.

Preferably, the baton 12 is powered by a rechargeable battery 76 which is located on circuit board 40. The above referenced radiation sensors 72 and 74 and a tilt switch 78 can be used to automatically power-on and power-off the baton 12 to conserve the charge of the battery 76. For example, the tilt switch 78 can automatically activate the baton 12 to power "on" when the longitudinal axis "B" of the baton 12 is tilted at an angle from the horizontal, such as at a 15° angle. Activation of the tilt switch 78 initiates a timer that powers-off the baton 12 if the baton 12 fails to generate a valid "play" and/or "mute" signal after a predetermined period of time, such as three minutes. The timer is reset after each valid signal is generated by the baton 12. The function of the timer can be accomplished, for instance, by the microprocessor 64. In addition, if the baton 12 is re-positioned in a substantially horizontal position, for instance within 15° of horizontal, the tilt switch 78 will cause the baton 12 to power-off after a short time delay, such as six seconds.

Typically, the batons 12 are vertically disposed when located in a battery recharging case (not shown). In the recharging case, both radiation sensors 72 and 74 are shielded. When this condition is detected, the baton automatically powers-off after a short time delay, for instance two seconds, despite activation of the tilt switch 78 and its associated timer. As a specific example, the radiation sensors can be photocells, and if the intensity of light measured by each photocell falls below a minimum threshold value, the baton 12 powers to an "off" condition. The above referenced powering scheme provided by the tilt switch 78 and radiation sensors 72 and 74 increase the battery life between recharging cycles.

As best illustrated in FIG. 2, the front face 26 of the baton 12 has an LED 80 that lights to visually indicate to a player that the baton is powered-on. Preferably, the LED 80 blinks when a valid play or mute signal is generated by the baton 12 to provide visual indication to the player that the player's movement and/or positioning of the baton 12 generated a signal to the base station 16.

As best illustrated in FIG. 3, the transceiver module 66 includes an antenna 82 for transmitting signals to the base station 16 and for receiving signals from the base station 16. Preferably, the transceiver module 66 includes a transceiver chip that is software controlled and that permits the operating parameters of the transceiver to be programmed. Preferably, the software of the transceiver 66 is programmed by the microprocessor 64. Thus, the microprocessor 64 can be programmed to control the operating parameters of the transceiver 66. The operating parameters can include, for instance, receive/transmit frequencies, bandwidth, data format, and like parameters.

The base station 16 itself also includes a receiver and transmitter, or transceiver, 84 and antenna 86 for communicating with the batons 12. Preferably, the base station 16 periodically transmits a sync signal at a predetermined frequency "F1" to the batons 12. For example, the sync signal can be transmitted every 50 milliseconds. The sync signal is utilized by the batons 12 to determine a unique time slot for each baton 12 to transmit a play and/or mute signal to the base station 16 one-at-a-time at a predetermined frequency "F2". Preferably, "F1" and "F2" are different frequencies, and the use of unique time slots prevents interference between signals transmitted by multiple batons 12 of the system 10.

Upon receiving a sync signal, an internal timer in each baton 12 is initiated, and upon expiration of the timer, the baton 12 transmits a signal, if any, to the base station 16. The internal timers of the batons 12 are set at staggered times thereby providing each baton with its own unique time slot for transmitting signals to the base station 16. For example, each time slot may be 1 millisecond in duration, and a first baton may be set to transmit in the first time slot after the sync signal, a second baton may be set to transmit in the second time slot after the sync signal, and so forth until all batons have had an opportunity to transmit a signal one-at-a-time to the base station 16. Thereafter, the base station 16 transmits another sync signal initiating another sequence of time slots.

Preferably, the signals transmitted by the batons include information concerning the elapsed time between when a valid signal was ready to be transmitted by the baton 12 to the base station 16 to when the signal was actually transmitted to the base station 16 during the baton's next available time slot. This information is utilized by the base station 16 to incorporate a consistent time delay between when a valid signal is generated by the player and when a corresponding sound is generated or muted by the tone generator 20. The time delay is preferably equal to the time between successive sync signals, for instance, 50 milliseconds.

Figure 5:
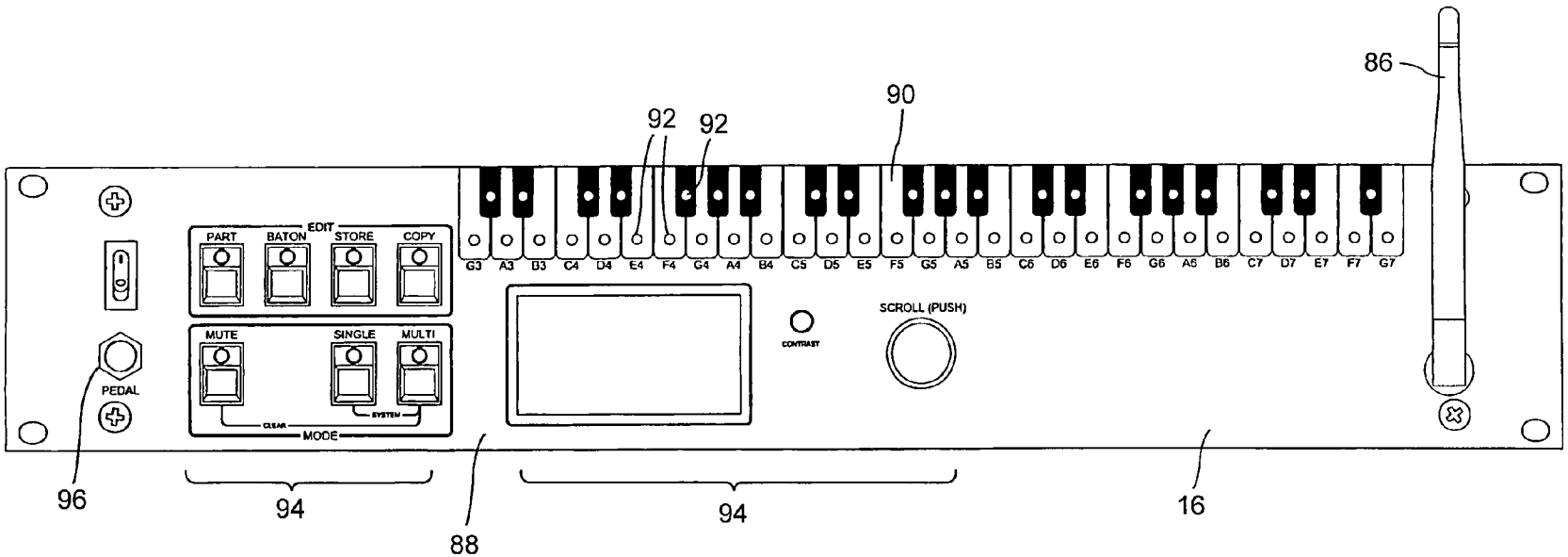
FIG. 5 is a plan view of the front face of a base station according to the present invention.

Preferably, the base station 16 includes a control panel 88, such as that illustrated in FIG. 5. The control panel includes a display 90 of each baton 12 (shown in the form of a piano keyboard in FIG. 5) with an LED 92 for each baton 12 that indicates when a sound corresponding to each particular baton is being played. The base station 16 also includes various controls 94 for setting the operation of the system 10. For instance, the sensitivity of how a play signal received from a baton 12 is converted into an output signal 18 by the base station 16 can be adjusted to alter the sounds ultimately produced by the system 10 (ie., relative volume levels, maximum and minium volume levels, quality and sustain of sounds, etc.). Preferably, this is accomplished by selecting a sensitivity curve, such as a linear, logarithmic, and/or exponential sensitivity curve.

As discussed above, preferably the base station 16 connects to a MIDI tone generator. Such generators are typically capable of generating thousands of different sounds, or voices, including sounds of musical instruments as wells sounds, such as, a dog barking, a crashing noise, a person's voice, etc. Thus, the controls 94 of the base station 16 enables the voice produced by each baton to be selected from thousands of voices and at different notes and/or chords. For example, each baton can play the same voice, such as the sound of an oboe, or a selected number of batons can produce one voice, such as the sounds of a piano, and another selected number of batons can produce a different voice, such as drum sounds. Of course, any variation, including number, type, and pitch, note or chords of voices and/or number of batons, is possible.

In addition, control panel 88 preferably includes a connection port 96 for use in connecting a foot-operated pedal to the base station 16 which can be used by a director or the like to quickly switch between different pre-programmed system settings (ie., number of batons, types of sound produced by each baton, sensitivity curve, etc.). Preferably, the controls 94 also permit the types of output signal 18 produced by the base station 16 to be selected, for instance, from "General MIDI 1" or "General MIDI 2" tone sources. In addition, preferably the base station 16 includes MIDI IN and/or MIDI THRU connection ports (not shown). This enables an alternate instrument, such as a keyboard, (not shown) to be connected to the base station 16 and permits a director of a player or group of players to play along with, or in place of, selected batons 12 to produce the same or different types of sounds as the batons 12.

While a preferred baton and electronic tone generation system has been described in detail, various modifications, alterations, and changes may be made without departing from the spirit and scope of the baton and electronic tone generation system according to the present invention as defined in the appended claims.

The invention claimed is:

1. A wireless handheld baton for communicating with a receiver of an electronic tone generation system for producing audible sounds in response to movements of the baton, comprising:

a housing having a grippable end portion;

a pair of radiation sensors positioned on opposite sides of said housing from which a differential is determinable; and a processor carried in said housing for causing the baton to transmit a mute signal when said differential determined from said radiation sensors exceeds a threshold level.

2. A baton according to claim 1, wherein each of said radiation sensors is a light sensor for sensing the intensity of light to which said housing is exposed.

3. A baton according to claim 2, wherein each of said light sensors is a photocell.

4. A baton according to claim 2, wherein said baton is battery powered and said baton automatically powers off when the light intensity sensed by each light sensor falls below a preset value.

5. A baton according to claim 2, further comprising a motion sensor carried in said housing for producing an electromagnetic signal in response to movement of the baton.

6. A baton according to claim 5, wherein said motion sensor is a piezoelectric reed mounted to flex about an axis.

7. A baton according to claim 5, wherein said electromagnetic signal generated by said motion sensor is a waveform, wherein a shape of said waveform generated by said motion sensor is produced as a function of baton orientation and direction of movement, and wherein the baton transmits a play signal only when said waveform generated by said motion sensor is of a predetermined shape and when said differential of light determined from said light sensors does not exceed said threshold level.

8. A baton according to claim 7, wherein said housing includes indicia for providing information with respect to proper orientation of the baton within a plane of movement, and wherein said motion sensor generates an electromagnetic waveform signal that is of said predetermined shape only when the baton is moved in said plane of movement with said baton in said proper orientation.

9. A baton according to claim 8, wherein an amplitude of said waveform determines a relative volume level of the audible sound produced in response to movement of the baton.

10. A wireless handheld baton for communicating with a receiver of an electronic tone generation system for producing audible sounds in response to movements of the baton, comprising:

a housing having a grippable end portion;

a pair of sensors for determining the intensity of light to which opposed external sides of said housing are exposed;

a circuit board mounted within said housing; and a motion sensor located within said housing having a contact end electrically interconnected to a circuit on said circuit board and a free end that is permitted to flex about an axis in response to movement of the baton, said axis being located a spaced distance from said contact end;

whereby said motion sensor generates an electromagnetic waveform signal based on the flexural movement of said free end.

11. A baton according to claim 10, wherein said motion sensor is a piezoelectric reed.

12. A baton according to claim 11, further comprising a block that mounts said reed to said circuit board and that engages opposite sides of said reed to define said axis such that said contact end of said reed remains stationary relative to said circuit board and said free end is permitted to flex about said axis.

13. A baton according to claim 12, wherein said light sensors are mounted on said block.

14. A baton according to claim 10, further comprising a battery within said housing for powering the baton, and a power LED which lights when the baton is powered up and which blinks when a valid play or mute signal is generated by the baton.

15. A baton according to claim 14, further comprising a tilt switch within said housing for automatically powering-up the baton when a longitudinal axis of the baton is tilted at a predetermined angle from horizontal and powers off the baton when said longitudinal axis is tilted to less than said predetermined angle for a predetermined period of time.

16. A baton according to claim 15, further comprising a timer within said housing for automatically powering off the baton if a valid play or mute signal is not generated by the baton within a predetermined amount of time, said timer automatically resets after a valid play or mute signal is generated by the baton.

17. An electronic tone generation system for producing audible sounds, comprising:

a plurality of separate handheld batons each capable of wireless communication with a base station, said batons transmit play or mute signals to said base station and said base station generates an output signal based on the signals received from said batons, each baton having a housing enclosing a circuit board on which a motion sensor, microprocessor and transceiver module is mounted, said motion sensor being adapted to generate a waveform signal as a function of baton orientation and movement, said transceiver module being adapted to send and receive signals from said base station and having operating parameters that are software controlled, and said microprocessor being programable to control said operating parameters of said transceiver module;

each signal transmitted to said base station from said batons containing information of elapsed time between when a valid signal was ready to be transmitted by the baton to when the signal was transmitted during a next available time slot to the base station; and said base station utilizing said elapsed time information to incorporate a consistent delay between when a valid signal is generated by a baton and when a corresponding sound is produced by the electronic tone generation system.

18. An electronic tone generation system according to claim 17, wherein said operating parameters of said transceiver module include at least one of receive frequency, transmit frequency, signal bandwidth and data format.

19. An electronic tone generation system according to claim 17, wherein said base station includes a transmitter for periodically transmitting a sync signal to said batons at a predetermined frequency.

20. An electronic tone generation system according to claim 19, wherein said microprocessor of each baton is programmed with a unique time slot for transmitting signals at a predetermined frequency to said base station after each sync signal is received such that said batons transmit signals to said base station one-at-a-time to said base station between successive sync signals.

21. An electronic tone generation system according to claim 17, wherein said base station includes controls for adjusting the sensitivity of how a play signal is played by a tone generator.

22. An electronic tone generation system according to claim 21, wherein said sensitivity is selectable from linear, logarithmic, or exponential sensitivity curves.

23. An electronic tone generation system according to claim 17, wherein said base station includes a control panel for selecting and storing settings of types of sounds produced by each of said baton, and includes a foot-actuated pedal for switching between different ones of said stored settings.

24. An electronic tone generation system according to claim 17, wherein said output signal generated by said base station is a MIDI output signal, and wherein said base station has controls for permitting the type of MIDI output signal to be selected.

25. An electronic tone generation system according to claim 17, wherein said base station includes a connection port for use in connecting an alternate instrument to said base station to permit said alternate instrument to produce audible sounds in addition to said plurality of batons or in place of a selected one or more of said batons.

* * * * *